US007871356B2

(12) United States Patent
Smith

(10) Patent No.: US 7,871,356 B2
(45) Date of Patent: Jan. 18, 2011

(54) ELLIPTICAL EXERCISER

(75) Inventor: Charles Smith, St-Georges-de-Beauce (CA)

(73) Assignee: Appareils D'Exercice Bodyguard Inc., Saint-Georges, Beauce, Québec (CA)

( * ) Notice: Subject to any disclaimer, the term of this patent is extended or adjusted under 35 U.S.C. 154(b) by 13 days.

(21) Appl. No.: 12/143,271

(22) Filed: Jun. 20, 2008

(65) Prior Publication Data

US 2008/0318736 A1 Dec. 25, 2008

Related U.S. Application Data

(60) Provisional application No. 60/945,408, filed on Jun. 21, 2007.

(51) Int. Cl.
*A63B 22/04* (2006.01)
*A63B 22/12* (2006.01)

(52) U.S. Cl. ..... 482/52; 482/62

(58) Field of Classification Search ..... 482/51–53, 482/57, 62

See application file for complete search history.

(56) References Cited

U.S. PATENT DOCUMENTS 5,573,480 A * 11/1996 Rodgers, Jr. ..... 482/57
5,762,381 A * 6/1998 Vogel et al. ..... 285/330
6,361,476 B1 * 3/2002 Eschenbach ..... 482/52
6,368,252 B1 * 4/2002 Stearns ..... 482/52
6,485,395 B1 * 11/2002 Stearns et al. ..... 482/57
6,544,146 B1 * 4/2003 Stearns et al. ..... 482/52
6,569,061 B2 * 5/2003 Stearns et al. ..... 482/52
6,599,050 B1 * 7/2003 Sjoo ..... 403/97
7,435,204 B2 * 10/2008 Wu et al. ..... 482/52
7,455,624 B2 * 11/2008 Liao Lai ..... 482/52
2004/0053748 A1 * 3/2004 Lo et al. ..... 482/52
2006/0166791 A1 * 7/2006 Liao et al. ..... 482/52
2008/0318735 A1 * 12/2008 Smith ..... 482/52

* cited by examiner

*Primary Examiner*—Steve R Crow
(74) *Attorney, Agent, or Firm*—Ogilvy Renault LLP

(57) ABSTRACT

An arm mechanism for an elliptical exerciser comprises a linkage having a first end pivotally mounted to a frame of the elliptical exerciser, and a second end receiving a reciprocating movement from a foot pedal of the elliptical exerciser. An arm member has a handling portion to be handled by a user of the elliptical exerciser, and a coupling portion to be coupled to the first end of the linkage. A coupling mechanism releasably couples the linkage to the arm member such that the linkage and the arm member rotate jointly about the frame upon the linkage receiving the reciprocating movement from the foot pedal in a coupled position of the coupling mechanism, and for decoupling the arm member from the linkage in a decoupled position of the coupling mechanism to prevent rotation of the arm member while the linkage rotates.

6 Claims, 8 Drawing Sheets

ELLIPTICAL EXERCISER

CROSS-REFERENCE TO RELATED APPLICATION

This patent application claims priority on U.S. Provisional Application No. 60/945,408, filed on Jun. 21, 2007.

BACKGROUND OF THE APPLICATION

1. Field of the Application

The present application relates to elliptical exercisers and, more particularly, to foot pedal mechanisms thereof, and to a relation between upper- and lower-body workouts in elliptical exercisers.

2. Background Art

Elliptical exercisers, also known as ellipticals, elliptical trainers and elliptical exercise machines, combine the natural stride provided by a treadmill and the simplicity of a stair climber. On an elliptical exerciser, a user stands upright comfortably while holding onto the exerciser's handlebars and strides in either a forward or reverse motion. The handlebars are often moveable and are synchronized with the pedals upon which the user strides, to provide a full upper- and lower-body workout.

Elliptical exercisers are unique in their ability to put minimal stress on the joints while offering a weight-bearing workout, and this has ramifications in the inhibition of the onset of osteoporosis. The feet of the user never leave the pedals of the exerciser, thereby eliminating any impact in the workout. Therefore, there is a reduced risk of injury from overusing any given muscle group, thereby facilitating training for anyone with back, knee, hip and joint problems. The low-impact, intensive, cardiovascular workout provided by the elliptical exerciser is achieved through natural and smooth motion.

The mechanisms incorporated into elliptical exercisers move in a continuous smooth motion and do not suffer the effects of direction reversal (e.g., in a stair-climber, the feet must change direction virtually instantaneously). In addition, elliptical exerciser technology provides a more functional pattern of movement. Since elliptical exercisers simulate a natural walking pattern, they can easily be accompanied by upper-body exercise. Many other devices, by their mechanical structure (e.g., treadmills) or by their pattern (e.g., cycling), do not readily adapt to upper-body workouts.

The various manufacturers of elliptical exercisers have developed many iterations of this basic technology. As a result, the state of the art includes a plurality of machines that have a different "feel"—e.g., the articulation of the ankle, knee and hip can be different.

SUMMARY OF THE APPLICATION

It is therefore an aim of the present application to provide a novel elliptical exerciser.

Therefore, in accordance with the present invention, there is provided an arm mechanism for an elliptical exerciser comprising: a linkage having a first end pivotally mounted to a frame of the elliptical exerciser, and a second end receiving a reciprocating movement from a foot pedal of the elliptical exerciser; an arm member having a handling portion to be handled by a user of the elliptical exerciser, and a coupling portion to be coupled to the first end of the linkage; a coupling mechanism for releasably coupling the linkage to the arm member such that the linkage and the arm member rotate jointly about the frame upon the linkage receiving the reciprocating movement from the foot pedal in a coupled position of the coupling mechanism, and for decoupling the arm member from the linkage in a decoupled position of the coupling mechanism to prevent rotation of the arm member while the linkage rotates.

Further in accordance with the present invention, there is provided a foot pedal for an elliptical exerciser comprising: a foot plate for supporting a foot of the user; a structural member supporting the foot plate and adapted to be connected to a reciprocating mechanism of the elliptical exerciser for moving with the reciprocating mechanism; and at least one of a lockable rotational joint between the foot plate and the reciprocating mechanism to adjust an orientation of the foot plate with respect to the reciprocating mechanism, and a lockable translational joint between the foot plate and the reciprocating mechanism to adjust a position of the foot plate with respect to the reciprocating mechanism.

DESCRIPTION OF THE PREFERRED EMBODIMENTS

Figure 1:
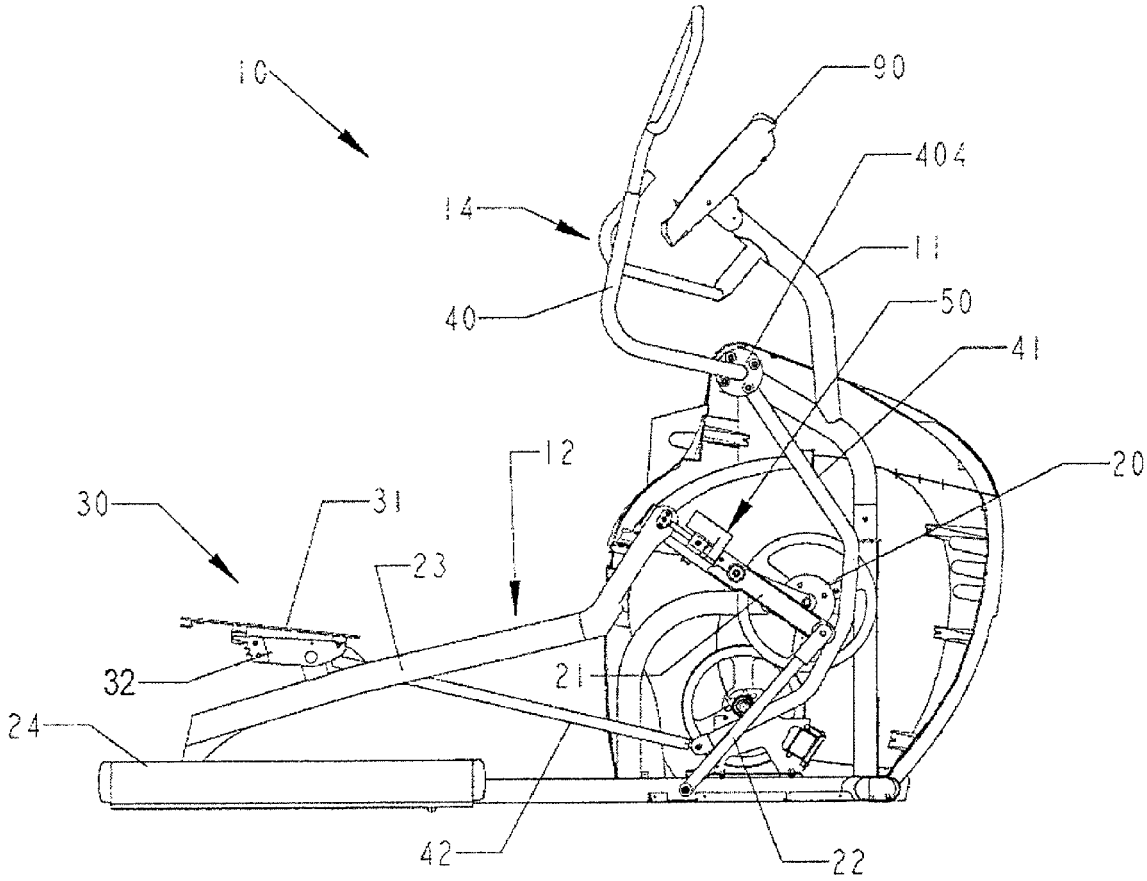
FIG. 1 is a right-side elevation view of an elliptical exerciser in accordance with a first embodiment of the present disclosure.
Figure 2:
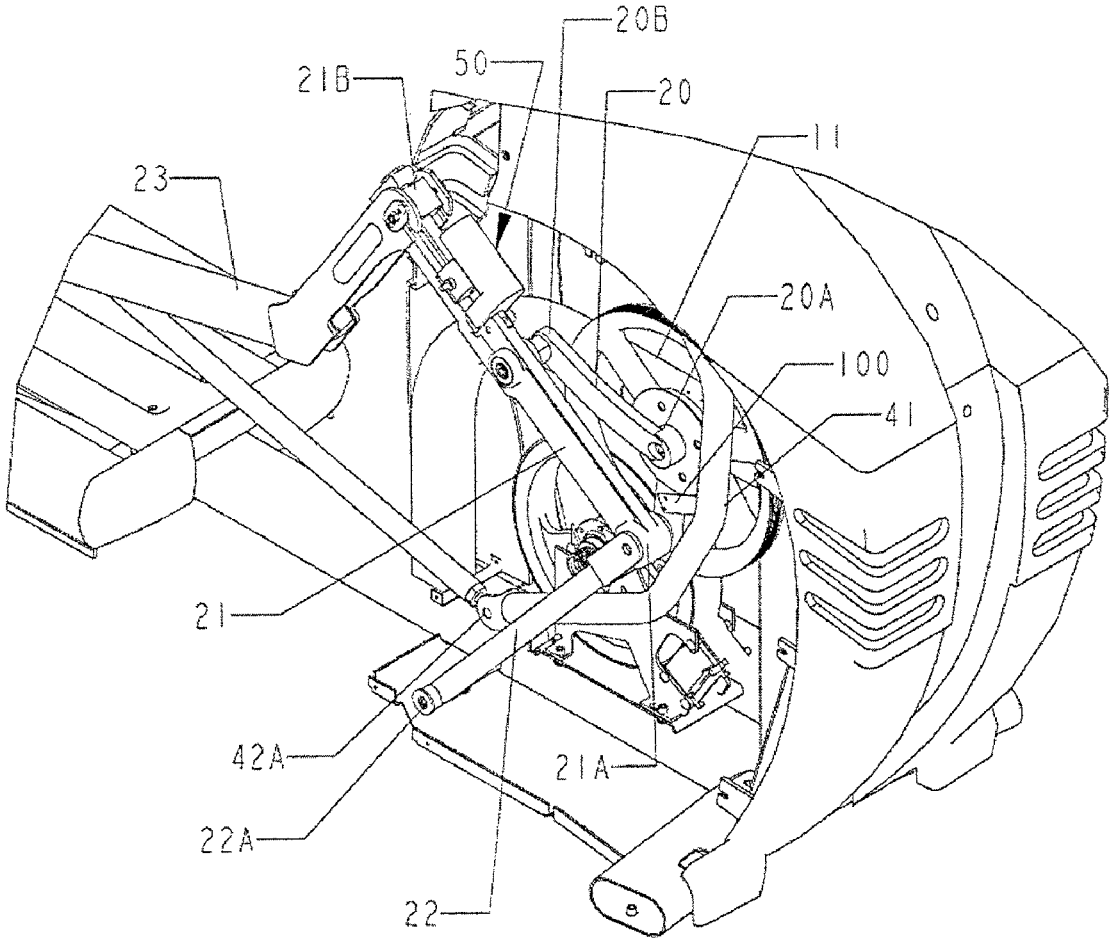
FIG. 2 is an enlarged perspective view of a foot mechanism of the elliptical exerciser of FIG. 1.

Referring now to the drawings, and more particularly to FIGS. 1 and 2, an elliptical exerciser in accordance with an embodiment is generally shown at 10. The exerciser 10 has a frame 11 supporting the various mechanisms and accessories of the exerciser 10, including the foot mechanism 12 and the arm mechanism 14.

The foot mechanism 12 is an assembly of linkages having pedals receiving the feet of the user. The specific assembly of linkages guides the feet into moving in an elliptical motion. The arm mechanism 14 is handled by the user, and guides the hands of the user in effecting a reciprocating movement. It is pointed out that the foot mechanism 12 and the arm mechanism 14 both consists of a left-side and a right-side portion. For simplicity purposes, only the right-side portion of the mechanism 12 and 14 will be described. The left-side portions of the mechanisms 12 and 14 are identical to the right-side portions.

The right-side portion of the foot mechanism 12 has a crank 20. The crank 20 is pivotally mounted to the frame 11 at its end 20A. The crank 20 rotates about the pivot axis of the end 20A, such that the opposed end 20B effects circular motions about the frame 11. The opposed end 20B of the crank 20 is pivotally mounted to a transmission member 21.

The transmission member 21 is centrally connected to the crank 20. The transmission member 21 has a first end 21A pivotally connected to a restriction member 22 and a second end 21B connected to a reciprocating member 23. The reciprocating member 23 supports a foot of the operator and therefore receives the forces that actuate the foot mechanism 120. The transmission member 21 receives the force from the reciprocating member 23, and transmits this force to the crank 20 and the restriction member 22. The crank 20, the transmission member 21 and the restriction member 22 interact to constrain the motion of the reciprocating member 23 to an elliptical pattern. The crank 20 is typically connected to a stride-adjustment actuator, that is controlled by the user to adjust a stride of the exerciser 10.

The restriction member 22 has a first end 22A pivotally connected to the frame 11, and a second end pivotally joined to the first end 21A of the transmission member 21.

The reciprocating member 23 has its first end pivotally connected to the second end 21B of the transmission member 21. A roller 23B is provided at the opposed end of the reciprocating member 23. The roller 23B is engaged in a track 24 of the frame 11, and moves back and forth in a translational reciprocating motion.

A foot pedal 30 is pivotally connected to the reciprocating member 23, between the roller 23B and the pivot connection with the second end 21B of the transmission member 21. The foot pedal 30 has a foot plate 31 that supports the foot of the user, and a structural member 32 by which the foot pedal 30 is connected to both the reciprocating member 23 and the arm mechanism 14.

The foot plate 31 of the foot pedal 30 moves in an elliptical pattern. The crank 20, the transmission member 21 and the restriction member 22 constrain the roller 23A to move back and forth, while constraining the opposed end of the reciprocating member 23 to displacement along an elliptical pattern. The second end 20B of the crank 20 moves in a circular pattern, thereby entraining the transmission member 21. The motion of the transmission member 21 is constrained by the restriction member 22, whereby the second end 21B of the transmission member 21, and thus the end of the reciprocating member 23 connected thereto, move along an elliptical path by the combined effect of the crank 20 and the restriction member 22 on the transmission member 21.

Figure 10:
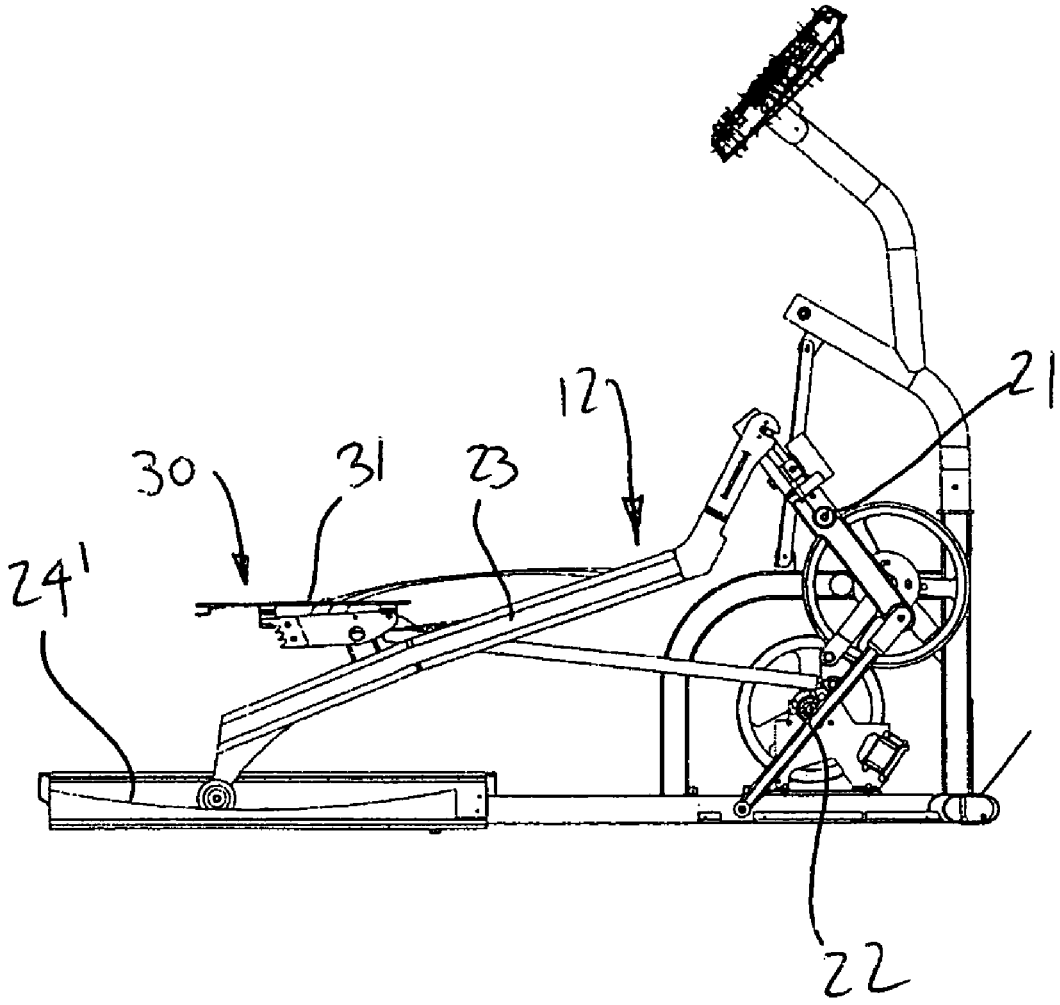
FIG. 10 is a simplified right-side elevation view of the elliptical exerciser of FIG. 1, with an arcuate track.
Figure 11:
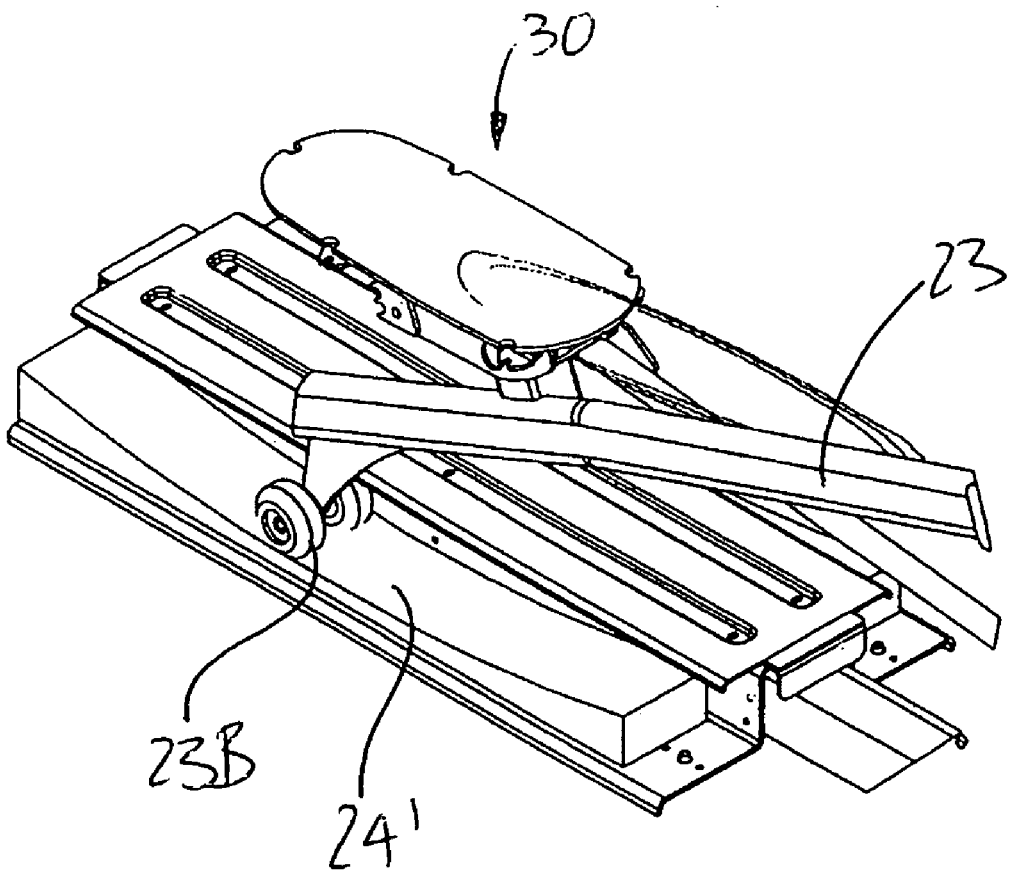
FIG. 11 is a perspective view of the arcuate track of FIG. 10.

In order to enhance the elliptical path, the track may be provided with an arcuate rolling surface. Such a configuration is illustrated in FIGS. 10 and 11, in which track 24' shows an arcuate rolling surface upon which the roller 23B rolls. Therefore, the roller 23B moves back and forth in an arcuate reciprocating motion. The curvature may be more or less accentuated to provide an elliptical pattern of greater or lesser amplitude.

The position of the foot pedal 30 on the reciprocating member 23 will have an effect on the amplitude of the elliptical pattern of motion. More specifically, the foot pedal 30 is brought closer to the roller 23A for an elliptical pattern of smaller amplitude.

Figure 4:
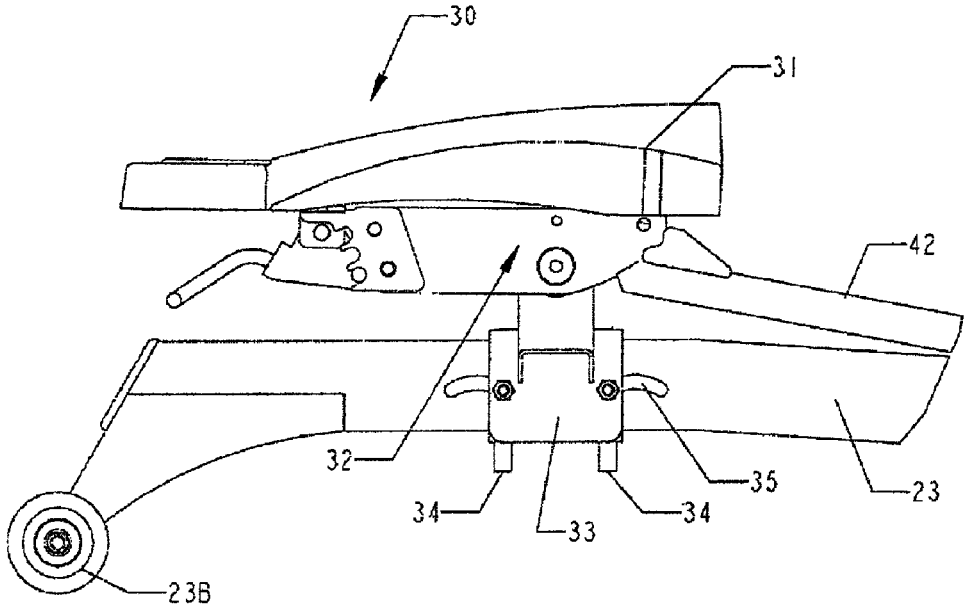
FIG. 4 is a side elevation view of the foot pedal of FIG. 3.
Figure 5:
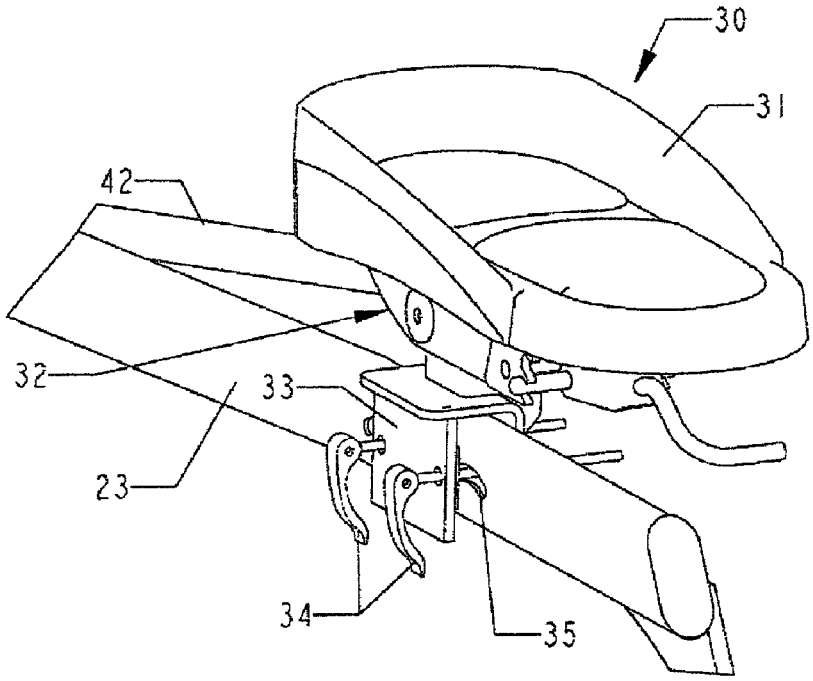
FIG. 5 is a enlarged perspective view of a stride-adjustment mechanism of the foot pedal of FIG. 3.

Accordingly, referring to FIGS. 4 and 5, the structural member 32 of the foot pedal 30 has a bracket 33 and quick—connect fasteners 34 that will allow the bracket 33 to be locked in slots 35 in the reciprocating member 23. The position of the foot pedal 30 on the reciprocating member 23 is therefore adjustable, to select an elliptical pattern of motion. The bracket 33, fasteners 34 and the slots 35 form an amplitude-adjustment mechanism for the stride, consisting of a lockable translational joint.

Figure 3:
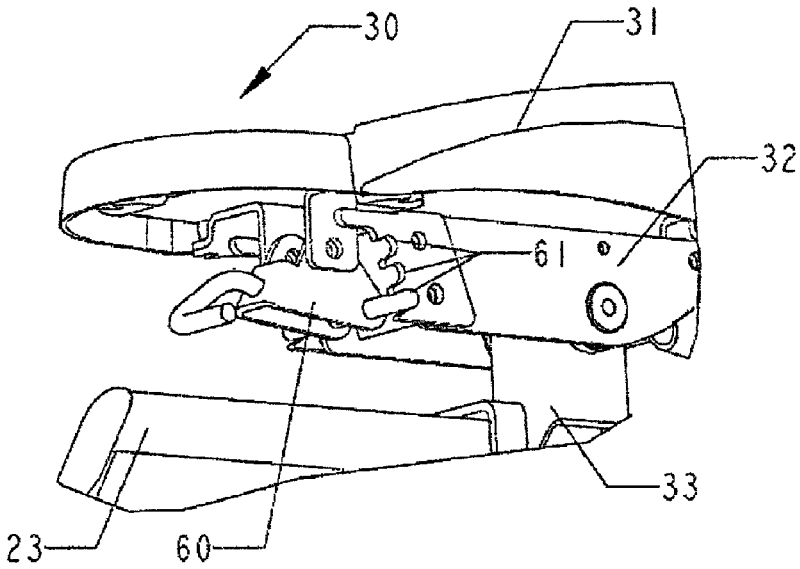
FIG. 3 is an enlarged perspective view of a foot pedal of the elliptical exerciser of FIG. 1, showing an orientation-adjustment mechanism.

An orientation of the foot pedal 30 is also adjustable in accordance with a preferred settings of a user. Referring to FIGS. 3 and 4, an orientation-adjustment mechanism has a clip 60 that is pivotable to engage three different slots 61. The foot plate 31 is therefore pivotable to fixed orientations with respect to the structural member 32. More than three of the slots 61 could be provided as well. Therefore, the foot pedal 30 and the structural member 32 form a lockable rotational joint.

Referring concurrently to FIGS. 1 and 2, the arm mechanism 14 has an arm member 40. The arm member 40 is pivotally connected to the frame 11 at axis 40A, and is directly connected to a linkage relating the arm member 40 to the foot pedal 30. In the illustrated embodiment, the linkage has an intermediary member 41 and an end member 42, but other configurations are considered.

The arm member 40 and the intermediary member 41 move together about the pivot axis 40A. The end member 42 is connected by a rotational joint 42A to a free end of the intermediary member 41. The opposed free end of the end member 42 is also connected by rotational joint to the structural member 32 of the foot pedal 30. Accordingly, motion of the foot pedal 30 will cause a reciprocating movement of the arm member 40, as a result of the transmission of forces via the end member 42 and the intermediary member 41.

Referring to FIG. 2, an extension mechanism 50 is provided on the transmission member 21. The extension member 50 is used to modify the distance between the axes of the ends 20B and 21B, to alter the elliptical pattern of movement of the foot pedal 30.

Figure 6:
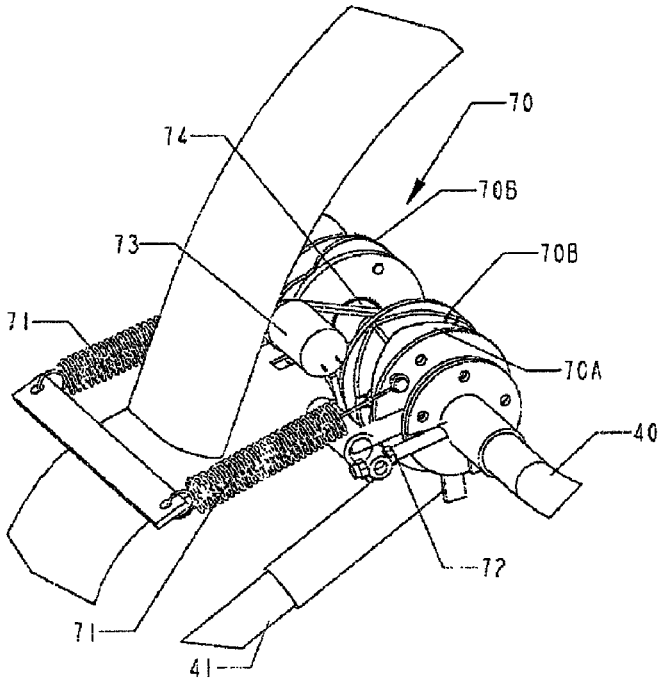
FIG. 6 is an enlarged perspective view of a coupling mechanism of an arm mechanism of the elliptical exerciser of FIG. 1.
Figure 7:
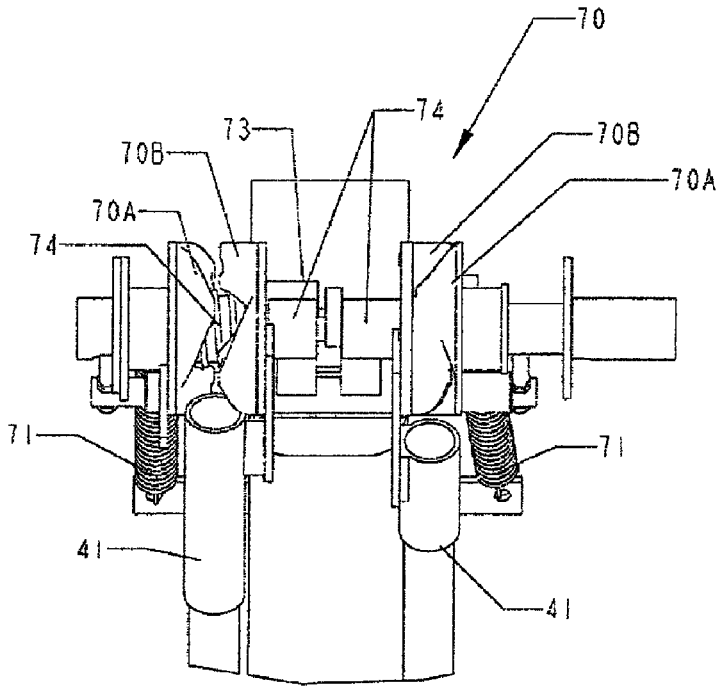
FIG. 7 is a front elevation view of the coupling mechanism of FIG. 6.

Referring to FIGS. 6 and 7, a coupling mechanism 70 is provided at the junction between the arm member 40 and the intermediary member 41. More specifically, the coupling mechanism 70 involves complementary coupling components 70A and 70B that engage to transmit motion between the arm member 40 and the intermediary member 41. As is seen in FIG. 7, the coupling mechanism 70 on the right-hand side is in a coupled position, whereas the left-hand side coupling mechanism 70 is in a decoupled position. The coupling/decoupling of the coupling mechanism 70 is actuated by a motor 73 and an endless screw 74. There may be a single motor 73 and endless screw 74 for both sides of the coupling mechanism 70 as illustrated in FIGS. 6 and 7 (with a belt transmission), or a pair of independent motor and endless screw. The coupling and decoupling of the coupling mechanism 70 is actuated by the user of the elliptical exerciser. As an alternative, the coupling mechanism may be actuated manually.

Biasing member 71 bias the arm members 40 forward when the arm members 40 are decoupled from the linkages. Accordingly, the arm members 40 will not be in the way of the user of the elliptical exerciser when not being used. The right-side and left-side coupling components 70B may be brought toward one another to disengage the arm member 40 and the intermediary member 41, as is partially shown in FIG. 7, in the decoupled position. A stopper 72 may be used to maintain the coupling mechanism 70 in the decoupled position. This disengagement enables the use of the elliptical exerciser 10 without the arm members 40. The coupling components 70A and 70B are cylinders having serrated surface for cooperative engagement.

Figure 8:
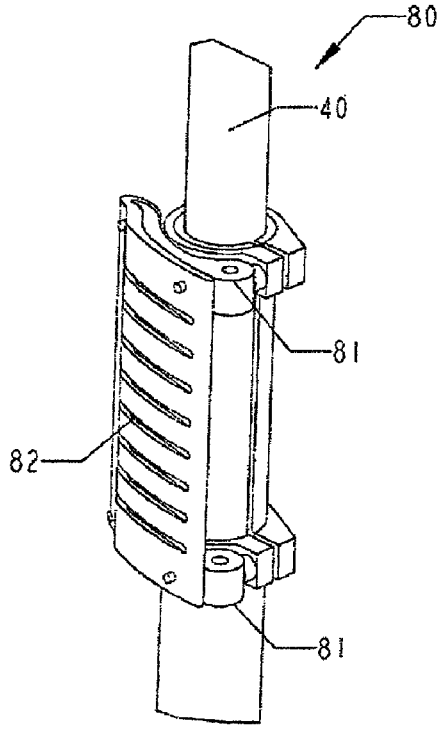
FIG. 8 is a perspective view of a height-adjustment mechanism of the arm mechanism of the elliptical exerciser of FIG. 1.

Referring concurrently to FIGS. 1 and 8, a height-adjustment mechanism 80 for the arm member 40 is illustrated. The height-adjustment mechanism 80 is provided for the user of the elliptical exerciser 10 to adjust the height of the arm member 40. The mechanism 80 has a pair of quick-connect collars 81, interrelated by a handle plate 82, Therefore, both quick-connect collars 81 are handled simultaneously to adjust the height of the arm member 40

Figure 9:
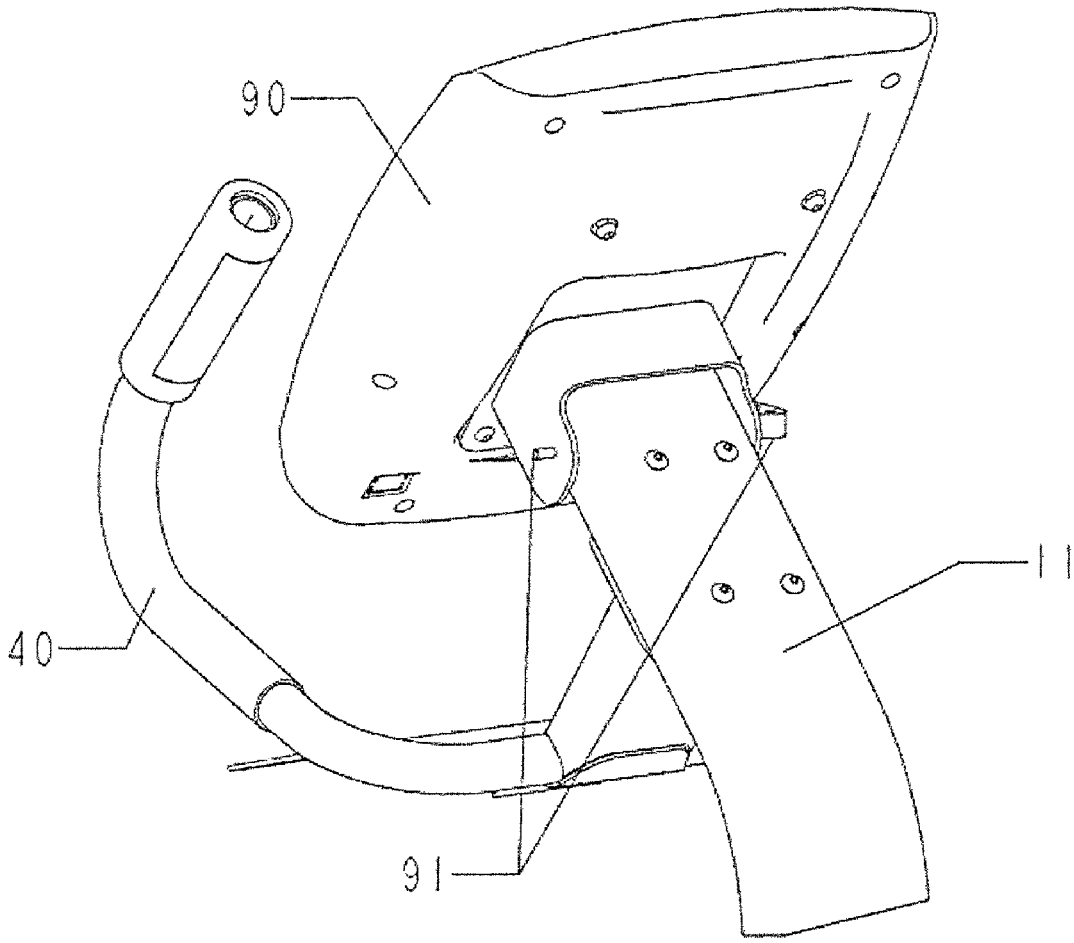
FIG. 9 is a perspective view of an orientation-adjustment mechanism supporting a monitor of the elliptical exerciser.

Referring to FIG. 9, a monitor 90 of the elliptical exerciser 10 is shown mounted to the frame 11 via an orientation-adjustment mechanism 91. Accordingly, depending on the size of the user of the elliptical exerciser 10, the monitor 90 can be oriented so as to be in line with the line of sight of the user.

Referring to FIG. 2, a pulley that is operatively connected to the foot mechanism 12 has a sensor portion 100 thereon. The sensor portion 100 is typically the passive member of the sensor, such as a magnet, that triggers an active sensor portion (not shown) secured to the frame 11. Accordingly, it is possible to determine the number of cycles/revolutions of the pulley and calculate values such as speed and distance traveled, amongst other parameters.

It is contemplated to determine the direction of movement of the foot mechanism 12 using the sensor portion 100. One method considered is to provide more than one sensor portion 100, with a sensor portion 100 on different spokes that are not diametrically opposed on the pulley Therefore, taking into account the time delay between triggers, it is possible to determine the direction of rotation of the pulley and hence the movement of the foot mechanism 12. Other possibilities are considered as well.

The invention claimed is:

1. An arm mechanism for an elliptical exerciser comprising:

a linkage having a first end pivotally mounted to a frame of the elliptical exerciser, and a second end receiving a reciprocating movement from a foot pedal of the elliptical exerciser;

an arm member having a handling portion to be handled by a user of the elliptical exerciser, and a coupling portion to be coupled to the first end of the linkage;

a coupling mechanism for releasably coupling the linkage to the arm member, the coupling mechanism having cylinders on the arm member and on the linkage, the cylinders being axially aligned and having matching serrated surfaces for coupling engagement such that the linkage and the arm member rotate jointly about the frame upon the linkage receiving the reciprocating movement from the foot pedal in a coupled position of the coupling mechanism, and for decoupling the arm member from the linkage in a decoupled position of the coupling mechanism to prevent rotation of the arm member while the linkage rotates.

2. The arm mechanism according to claim 1, wherein the arm member is biased away from the user of the elliptical exerciser in the decoupled position of the coupling mechanism.

3. The arm mechanism according to claim 2, further comprising an actuated endless screw to switch the coupling mechanism between the coupled position and the decoupled position.

4. The arm mechanism according to claim 1, wherein the arm member has a height-adjustment mechanism for the adjustment of the length of the arm member between the handling portion and the coupling portion.

5. The arm mechanism according to claim 4, wherein the height-adjustment mechanism has at least one quick-connect collar.

6. The arm mechanism according to claim 1, wherein the linkage has an intermediary member and an end member interconnected by a rotational joint, the intermediary member being releasably coupled to the arm member by the coupling mechanism, and the end member adapted to be connected to a foot pedal.

* * * * *